United States Patent [19]

Baltz

[11] Patent Number: 4,485,767

[45] Date of Patent: Dec. 4, 1984

[54] ENGINE OVERHEAT WARNING SYSTEM

[75] Inventor: Gene F. Baltz, Lake Villa, Ill.

[73] Assignee: Outboard Marine Corporation, Waukegan, Ill.

[21] Appl. No.: 459,340

[22] Filed: Jan. 20, 1983

[51] Int. Cl.[3] ..... F02B 77/08

[52] U.S. Cl. ..... 123/41.15; 123/198 D

[58] Field of Search .... 123/198 D, 198 DB, 198 DC, 123/41.15

[56] References Cited

U.S. PATENT DOCUMENTS

| | | | |
|---|---|---|---|
| 1,386,763 | 9/1920 | Bretthauer . | |
| 1,397,424 | 5/1921 | Jarvis . | |
| 1,464,222 | 6/1921 | Sager . | |
| 1,541,073 | 6/1925 | Sohm | 123/41.15 |
| 1,796,826 | 12/1929 | Buckert . | |
| 2,066,000 | 2/1935 | Gillet . | |
| 2,445,625 | 7/1948 | Meinholdt | 123/41.15 |
| 2,475,343 | 7/1949 | Wellman | 123/41.15 |
| 3,092,070 | 4/1961 | Wright . | |
| 3,153,403 | 10/1964 | Dobbs | 123/41.15 |
| 4,016,851 | 4/1977 | Rouam | 123/198 D |
| 4,029,074 | 6/1977 | Sliger . | |
| 4,051,829 | 10/1977 | Durham | 123/198 D |
| 4,126,114 | 11/1978 | Davis | 123/198 D |
| 4,142,503 | 3/1979 | Hatz et al. | 123/198 D |
| 4,381,744 | 5/1983 | Terry | 123/41.15 |

*Primary Examiner*—Ira S. Lazarus

*Attorney, Agent, or Firm*—Michael, Best & Friedrich

[57] ABSTRACT

An engine overheat warning system for an internal combustion engine, which system includes a source of gas with a pressure different from atmospheric pressure and a pneumatic horn. The engine overheat warning system also includes a conduit communicating between the source of gas and the pneumatic horn and a temperature sensing valve located in the conduit and connected to the engine for causing communication between the source of gas and the pneumatic horn when the engine reaches an overheat condition. When the source of gas and pneumatic horn are thus in communication, the pneumatic horn produces an audible engine overheat warning.

In one embodiment, the source of gas with a pressure different from atmospheric pressure is an intake manifold of an internal combustion engine.

7 Claims, 3 Drawing Figures

ENGINE OVERHEAT WARNING SYSTEM

BACKGROUND OF THE INVENTION

This invention relates to means for warning an operator of an engine overheat condition and, more particularly, such means which are provided for in engines which do not have an electrical system.

Attention is directed to Davis U.S. Pat. No. 4,126,114 issued Nov. 21, 1978 which discloses a temperature sensing valve used for actuating an engine protection device such as a fuel shut-off valve in response to an engine overheat condition.

SUMMARY OF THE INVENTION

This invention provides an engine overheat warning system for an internal combustion engine. The system includes a source of gas with a pressure different from atmospheric pressure and a pneumatic horn. The engine overheat warning system also includes conduit means communicating between the source of gas and the pneumatic horn and temperature sensing valve means located in the conduit means and connected to the engine for causing communication between the source of gas and the pneumatic horn when the engine reaches an overheat condition. When the source of gas and pneumatic horn are thus in communication, the pneumatic horn produces an audible engine overheat warning.

In one embodiment, the source of gas with a pressure different from atmospheric pressure is an intake manifold of an internal combustion engine.

In one embodiment, the temperature sensing valve means comprises heat receiving means coupled to an internal combustion engine for receiving heat from the internal combustion engine, means defining a receptacle within the heat receiving means, temperature responsive means disposed within the receptacle for expanding and contracting in response to the temperature of the heat receiving means, valve means between the source of gas and the pneumatic horn, and means in mechanical contact with the temperature responsive means for opening the valve means to cause the source of gas to be in communication with the pneumatic horn in response to expansion of the temperature responsive means.

In one embodiment, the temperature sensing valve means comprises a body having a first bore and a second bore in communication with the first bore. The temperature sensing valve means also includes an annular seat between the first bore and the second bore, a first port communicating with the source of gas and the first bore and a second port communicating with the pneumatic horn and the second bore. The temperature sensing valve means also includes temperature sensing means coupled to the engine for receiving heat from the engine. The temperature sensing means includes a temperature sensing tip which has an internal longitudinally extending receptacle. The temperature sensing means also includes a temperature responsive material disposed within the receptacle for expanding and contracting in response to the temperature of the temperature sensing tip.

The temperature sensing valve means also includes a piston including a first end positioned adjacent the annular seat and a second end positioned adjacent the temperature responsive material. The piston is slideable in the body between a first position wherein the first end is outside of the annular seat and a second position wherein the first end extends through the annular seat.

The temperature sensing valve means also includes sealing means which is located adjacent the annular seat for blocking communication between the first port and the second port when the piston is in the first position, and which is opened by the piston to provide a path between the first port and the second port when the piston is in the second piston.

Other features and advantages of embodiments of the invention will become apparent upon reviewing the following drawings, the detailed description and the appended claims.

Figure 1:
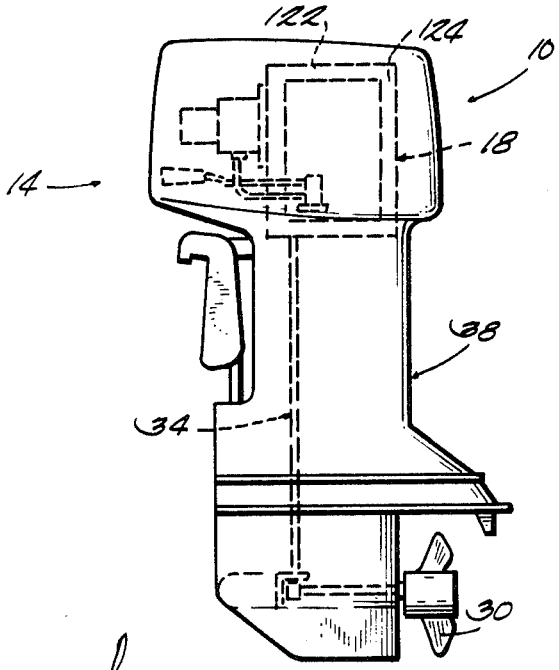
FIG. 1 is a side view of a marine propulsion device including various features of the invention.

Before explaining at least one embodiment of the invention in detail, it is to be understood that the invention is not limited in its application to the details of contruction and the arrangements of the components set forth in the following description or illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EMBODIMENT

As illustrated in FIG. 1, this invention provides a marine propulsion device 10 which includes an engine overheat warning system 14 and an internal combustion engine 18. The internal combustion engine 18 is operably connected to a drive system 34 located in a lower unit 38 of the marine propulsion device 10 for rotatably driving a propeller 30.

The engine overheat warning system 14 includes a source 42 of gas with a pressure different from atmospheric pressure, a pneumatic horn 46, conduit means 50 communicating between the source 42 of gas and the pneumatic horn 46, and temperature sensing valve means 58 located in the conduit means 50 and connected to the engine 18 for causing communication between the source 42 of gas and the pneumatic horn 46 when the engine 18 reaches an overheat condition. When the pneumatic horn 46 is in communication with the source 42 of gas with pressure different from atmospheric pressure, gas passes through the conduit means 50 and excites a reed 62 or other noise-making device responsive to airflow within the pheumatic horn 46 in order to produce an audible engine overheat warning. An operator using the marine propulsion device 10, upon hearing the audible engine overheat warning, can shut off the internal combustion engine 18 in order to avoid damage to the engine 18 resulting from the engine overheat condition.

The source 42 of gas with a pressure different from atmospheric pressure comprises the intake manifold of the internal combustion engine 18. When the internal combustion engine 18 demands air from the intake manifold 42, a vacumm is produced in the intake manifold which causes air to be sucked through the conduit means 50 to produce the audible warning from the pneumatic horn 46.

The temperature sensing valve means 58 comprises body 66 including heat receiving means 70, means defining a receptacle 74 within the heat receiving means 70, temperature responsive means 78 disposed within the receptacle 74 for expanding and contracting in response to the temperature of the heat receiving means 70, valve means 82 between the source 42 of gas and the pneumatic horn 46 and means 78 for opening the valve means 82 to cause communication between the source 42 of gas and the pneumatic horn 46 in response to expansion of the temperature responsive means 78.

The body 66 of the temperature sensing valve means includes a first bore 90, a first port 94 in communication with the first bore 90 and connected to a first conduit 98 of the conduit means 50 in communication with the intake manifold 42, and a second bore 102 in communication with the first bore 90. The body 66 also includes a second port 106 in communication with the second bore 102 and connected to a second conduit 110 of the conduit means 50 in communication with the pneumatic horn 46.

The heat receiving means 70 comprises the lower portion of the body 66 and includes a temperature sensing tip 114 which is threaded and secured in a bore 118 in a housing 122 of the internal combustion engine 18. More particularly, the temperature sensing tip 114 can be connected to the head of the engine 18, the cooling jacket 124 of the engine 18, or some other part of the engine housing 122 which will heat when the engine 18 is in an overheat condition.

The temperature sensing tip 114 includes therein the internal longitudinally extending receptacle 74 which houses the temperture responsive means 78. The temperture responsive means 78 comprises a temperature responsive material which will expand significantly when the engine 18 reaches a predetermined overheat temperature. The material can be a wax which melts at the desired temperature or a medium density polyethylene rod.

The valve means 82 includes a radially inwardly extending annular seat 126 located at the point of connection of the first bore 90 to the second bore 102 and means 128 for sealing the opening in the annular seat 126. The sealing means 128 comprises a ball 130 which rests in the annular seat 126 and completely blocks communication between the first bore 90 and the second bore 102. The sealing means 128 also includes biasing means for biasing the ball 130 toward the annular seat 126. The biasing means comprises a spring 134 located in the second bore 102 and positioned between one end 138 of the second bore 102 and the ball 130.

Figure 2:
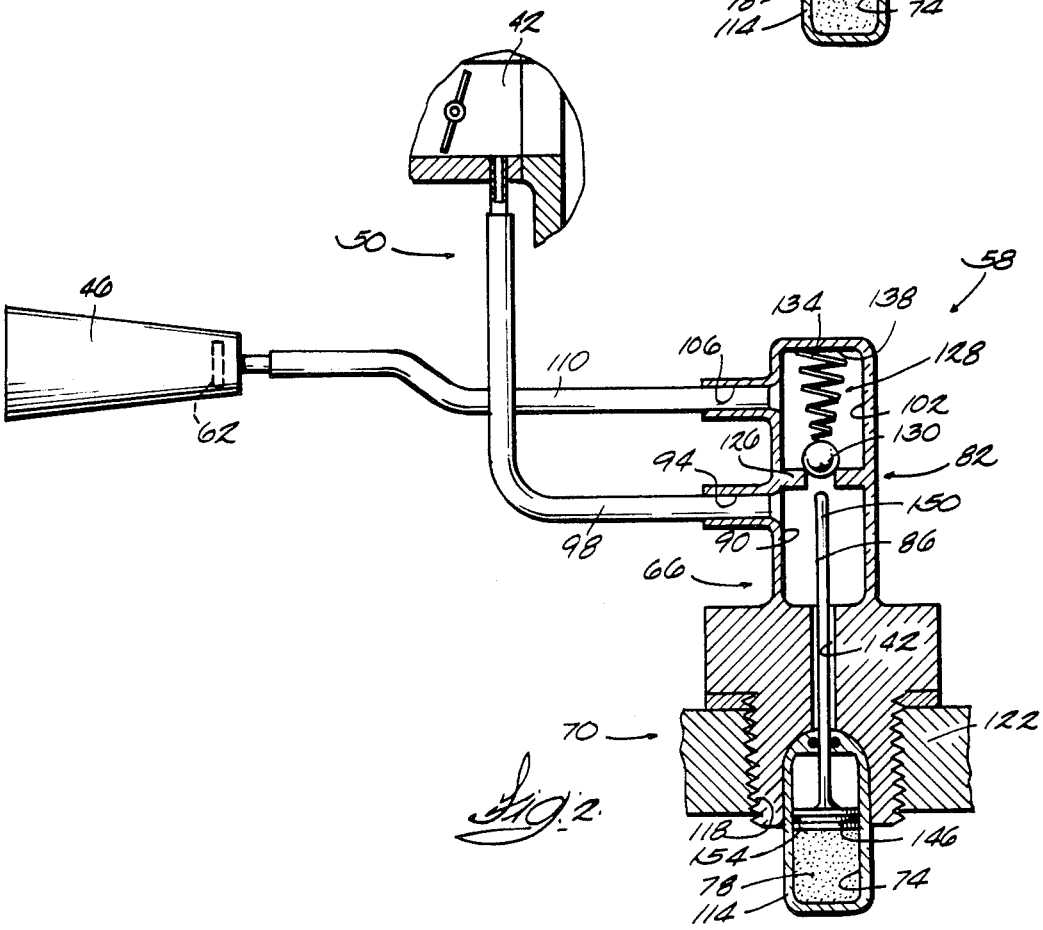
FIG. 2 is a side view partially in section of a engine overheat warning system including temperature sensing valve means in a first position wherein a pneumatic horn is not in communication with an intake manifold.

The means 86 in mechanical contact with the temperature responsive means 78 for opening the sealing means 128 in response to expansion of the temperature responsive means 78 comprises a piston located in the lower portion 70 of the body 66 and slidably received in a piston bore 142 extending between the first bore 90 and the receptacle 74. The piston 86 includes a firt end 146 adjacent the annular seat 126 and a second end 150 adjacent the temperature responsive means 78, as shown in FIG. 2. The second end 150 includes suitable sealing means 154.

Figure 3:
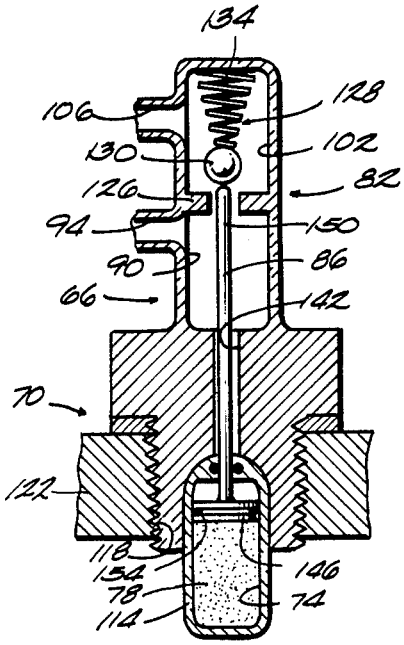
FIG. 3 is another cross-sectional view of the temperature sensing valve means in FIG. 2 showing the temperature sensing valve means in a second position wherein the pneumatic horn is in communication with the intake manifold.

The piston 86 is slideably between a first position, as shown in FIG. 2, and a second position, as shown in FIG. 3. In the first position, the temperature responsive means 78 has not expanded and the first end 146 of the piston 86 is located outside of the annular seat 126 and in the first bore 90. As the temperature responsive means 78 expands, the first end 146 of the piston 86 moves toward the annular seat 126 and eventually passes into the annular seat 126 in order to displace the ball 130 thereby opening communication between the first bore 90 and the second bore 102. The piston 86 has a diameter substantially less than the diameter of the first bore 90 so gas can pass around the piston 86 and through the first bore 90 to the first port 94.

Various of the features of the invention are set forth in the following claims:

I claim:

1. An engine overheat warning system for an internal combustion engine, said system including a source of gas with a presure different from atmospheric pressure, a pneumatic horn, conduit means communicable between said source and said pneumatic horn, and temperature sensing valve means for communicating said source with said pneumatic horn when the engine reaches an overheat condition so as to effect production by said pneumatic horn of an audible engine overheat warning, said temperature sensing valve means including a valve element which is located in said conduit means and which is normally closed in the absence of an overheat condition, and an expandible and a contractable temperature sensative material which is subject to engine temperature, which is independent of said source of gas, and which is operably connected to said valve element for opening thereof in response to extension of said material incident to an overheat condition.

2. An engine overheat warning system in accordance with claim 1 and wherein the internal combustion engine includes said source of gas.

3. An engine overheat warning system comprising an internal combustion engine including an intake manifold providing a source of gas at a pressure different from atmospheric pressure, a pneumatic horn, conduit means communicating between said source and said pneumatic horn, and temperature sensing valve means located in said conduit means and connected to said engine for causing communication between said source and said pneumatic horn when said engine reaches an overheat condition so that said pneumatic horn produces an audible engine overheat warning.

4. An engine overheat warning system for an internal combustion engine, said system including a source of gas with a pressure different from atmospheric pressure, a pneumatic horn, conduit means communicating between said source and said pneumatic horn, and temperature sensing valve means located in said conduit means and connected to the engine for causing communication between said source and said pneumatic horn when the engine reaches an overheat condition so that said pneumatic horn produces an audible engine overheat warning, said temperature sensing valve means comprising heat receiving means coupled to the internal combustion engine for receiving heat from the internal combustion engine, means defining a receptacle within said heat receiving means, temperature responsive means disposed within said receptacle for expanding and contracting in response to the temperature of said heat recieving means, valve means between said source and said pneumatic horn, and means in mechanical contact with said temperature responsive means for opening said valve means to cause said source of gas to be in communication with said pneumatic horn in response to expansion of said temperature responsive means.

5. An engine overheat warning system for an internal combustion engine, said system including a source of gas with a pressure different from atmospheric pressure, a pneumatic horn, conduit means communicating between said source and said pneumatic horn, and temperature sensing valve means located in said conduit means and connected to the engine for causing communication between said source and said pneumatic horn when the engine reaches an overheat condition so that said pneumatic horn produces an audible engine overheat warning, said temperature sensing valve means comprising a body including a first bore, a second bore in communication with said first bore, an annular seat between said first bore and said second bore, a first port communicating with said source of gas and said first bore, a second port communicating with said pneumatic horn and said second bore, temperature sensing means coupled to the engine for receiving heat from the engine, said temperature sensing means including a temperature sensing tip having an internal longitudinally extending receptacle and a temperature responsive material disposed within said receptacle for expanding and contracting in response to the temperature of said temperature sensing tip, a piston including a first end positioned adjacent said annular seat and a second end positioned adjacent said temperature responsive material, said piston being slideable in said body between a first position wherein said first end is outside of said annular seat and a second position wherein said first end extends through said annular seat, and sealing means located adjacent said annular seat for blocking communication between said first port and said second port when said piston is in the first position, and displaceable to an open position to provide a path between said first port and said second port when said piston is in the second position.

6. An engine overheat warning system for an internal combustion engine including an intake manifold subject to a pressure variable below atmospheric pressure, the warning system comprising a pneumatic horn, conduit means communicating between said intake manifold and said pneumatic horn, and temperature sensing valve means located in said conduit means and connected to the engine for placing said intake manifold in communication with said pneumatic horn when the engine reaches an overheat condition so that said pneumatic horn produces an audible engine overheat warning.

7. An engine overheat warning system for an internal combustion engine, said system including a source of gas with a pressure different from atmospheric pressure, a pneumatic horn, conduit means communicable between said source and said pneumatic horn, and temperature sensing valve means for communicating said source with said pneumatic horn when said engine reaches an overheat condition so as to effect production by said pneumatic horn of an audible engine overheat warning, said temperature sensing valve means including a valve element which is located in said conduit means and which is normally closed in the absence of an overheat condition, and an expandible and a contractable temperature sensitive material which is subject to engine temperature, which is independent of said source of gas, and which is operably connected to said valve element for opening thereof in response to extension of said material incident to an overheat condition.

* * * * *